US006026984A

United States Patent [19]

Perrin

[11] Patent Number: 6,026,984

[45] Date of Patent: Feb. 22, 2000

[54] DISPLAY CAROUSEL

[75] Inventor: Kim D. Perrin, Norwalk, Conn.

[73] Assignee: Mechtronics Corporation, Stamford, Conn.

[21] Appl. No.: 09/065,329

[22] Filed: Apr. 23, 1998

[51] Int. Cl.[7] ..... B65G 59/00

[52] U.S. Cl. ..... 221/132

[58] Field of Search ..... 221/132, 131, 221/123, 112, 92, 103, 251, 252, 289, 299

[56] References Cited

U.S. PATENT DOCUMENTS 5,667,096 9/1997 Wu ..... 221/132

*Primary Examiner*—Kenneth W. Noland
*Attorney, Agent, or Firm*—Wiggin & Dana; William B. Slate

[57] ABSTRACT

A device for displaying and dispensing articles above a horizontal surface includes a turntable for engaging the surface and supporting the device. A base is held above the turntable for rotation about a central vertical axis. A top is held above the base. A stack of article-holding tiers is positioned between the base and the top. Each tier has a plurality of groups of elongate stalls, each stall in a group configured to hold one article. The stalls in each group are arrayed generally side-by-side with each other and each stall has an open outboard end for removal of articles from the stall. A corresponding plurality of groups of blocking members are each associated with a corresponding group of stalls. Each blocking member is associated with one stall in the associated group of stalls. Either the group of blocking members or its associated group of stalls is a moveable group, movable as a unit between a first position wherein the blocking members substantially prevent removal of the articles held by the associated stalls and a second position wherein extraction of such articles past the blocking members is possible. The movable group is biased toward the first position.

13 Claims, 8 Drawing Sheets

DISPLAY CAROUSEL

BACKGROUND OF THE INVENTION

1. Field of the Invention

The invention relates to retail displays. More particularly, the invention relates to countertop displays of a type suitable for displaying articles such as bands for wristwatches.

2. Description of the Art

Watchbands are commonly packaged in transparent display boxes, often comprising a transparent five-sided polystyrene cover and an opaque back. One typical size for such a box is 5.35 inches long by 0.980 inches high by 0.435 inches wide. A variety of types of racks and cases have been utilized to display and dispense watchbands. In the retail environment, watchbands are typically sold in the jewelry departments of stores, with the display rack or case positioned on a countertop. Since many countertops are on glass display cases, the presence of the rack interferes with viewing of the contents of the display case. It is therefore desirable to provide a display which makes space-efficient use of the countertop.

In view of the fact that the marketplace provides a wide variety of styles of watchband and a wide variety of sizes (widths) within each style, the number of watchbands necessary or desirable to stock in a retail establishment is rather high. For example, watchbands commonly come in twelve widths: 6, 8, 10, 11, 12, 13, 14, 16, 18, 19, 20 and 22 millimeters. Even if a typical style of watchband comes in only four of those widths, it is necessary to provide a display that can hold one hundred and sixty bands in order to enable the seller to stock forty varieties of watchband without duplication. To allow for duplication, so that restocking is not necessary after each sale, a greater number of spaces is desirable. Conventional displays either lack adequate space to accommodate a plethora of sizes and styles of bands, or, if they do provide enough space, they lack the capacity to be expanded to fit a growing business. Accordingly, there exists a need in the watchband marketing community for an expandable display case that is easily expanded and countertop mounted. The present invention provides a solution to that need.

BRIEF SUMMARY OF THE INVENTION

In one aspect, the invention is directed to a device for displaying and dispensing elongate articles above a horizontal surface such as a floor or countertop. The device includes a turntable for engaging the surface and supporting the device. A base is held above the turntable for rotation about a central vertical axis. A top is held above the base. A stack of article-holding tiers is positioned between the base and the top. Each tier has a plurality of groups of elongate stalls, each stall in a group configured to hold one article. The stalls in each group are suitably arrayed generally side-by-side with each other and each stall has an open outboard end for removal of articles from the stall. A corresponding plurality of groups of blocking members are each associated with a corresponding group of stalls. Each blocking member is associated with one stall in the associated group of stalls. Either the group of blocking members or its associated group of stalls is a moveable group, movable as a unit between a first position wherein the blocking members substantially prevent removal of the articles held by the associated stalls and a second position wherein extraction of such articles past the blocking members is possible. The movable group is biased toward the first position.

Other aspects of the invention may include one or more additional features. The groups of stalls may be the movable groups. The stalls may be arrayed from an outboard stall to an inboard stall, the outboard stall extending generally along a perimeter of the associated tier. Each stall may have a bottom face, an outboard side face, an inboard side face, and an inboard end face. In each tier there may be four groups of stalls and four groups of blocking members. Each tier may have a generally octagonal perimeter and the stalls in each group may be staggered so that outboard ends of articles held by such stalls fall along a line proximate one side of such octagonal perimeter and the outboard stall falls generally along an adjacent side of such octagonal perimeter.

For each tier there may be an associated unitarily molded plastic shelf. Each group of stalls may be formed by a unitarily molded tray, slideably carried atop the associated shelf for translation between the associated first and second positions. Each group of blocking members may comprise a plurality of upwardly-extending fingers of the associated shelf. For each given tier from a lowermost tier to a penultimate tier, each group of blocking members may further comprise a plurality of fingers depending from an underside of the shelf associated with the tier above the given tier.

Each tier may include at least one latch movable between locked and unlocked conditions. In the locked condition, the latch prevents movement of an associated one of the trays to its second position. In the unlocked condition the latch does not prevent movement of the tray to its second position. For each given tier from a lowermost tier to a penultimate tier, each such latch may be coupled to a latch of the tier above the given tier so as to be driveable between the locked and unlocked conditions via the latch of the tier above the given tier. The latches of the tiers may form nested stacks of latches, each stack associated with one tray of each tier. The latch of the uppermost tier may be coupled to an associated lock carried by the top. The base may consist essentially of a first molded piece while the top consists essentially of a second molded piece, substantially identical thereto. The device may be configured so as to display and dispense articles 0.435 inches wide by 0.980 inches high by 5.35 inches long.

Among the advantages of the invention is the facilitating of a high degree of modularity. This allows for the simultaneous yet economical provision of a variety of different sizes of carousels (e.g., carousels with different numbers of tiers) for different retailers. For example, a large department store selling a high volume and/or wide variety of watchbands could be provided with a twenty tier carousel whereas a retailer selling a lower volume and/or smaller variety of watchbands (e.g., a drugstore) could receive a ten tier unit. Furthermore, the removal and addition of tiers allows a given retailer to correspondingly expand or contract the unit when the inventory and/or selection of watchbands increases or decreases.

These and other aspects of the present invention will be readily apparent upon reading the following detailed description of the invention, as well as the drawing and the claims.

BRIEF DESCRIPTION OF THE SEVERAL VIEWS OF THE DRAWING

Like reference numbers and designations in the several views indicate like elements.

DETAILED DESCRIPTION OF THE INVENTION

Figure 1:
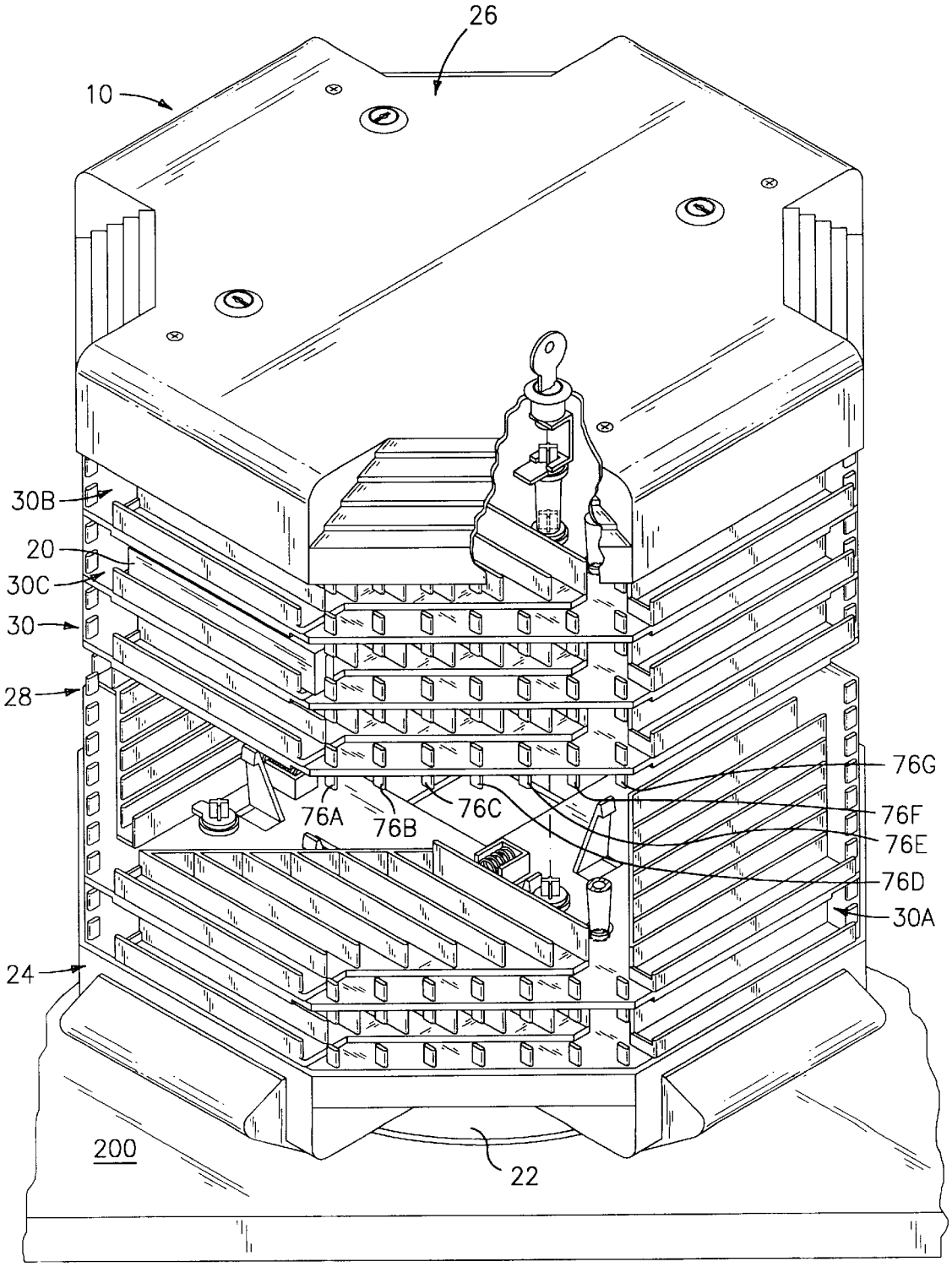
FIG. 1 is a perspective view of a display device according to principles of the invention.
Figure 2:
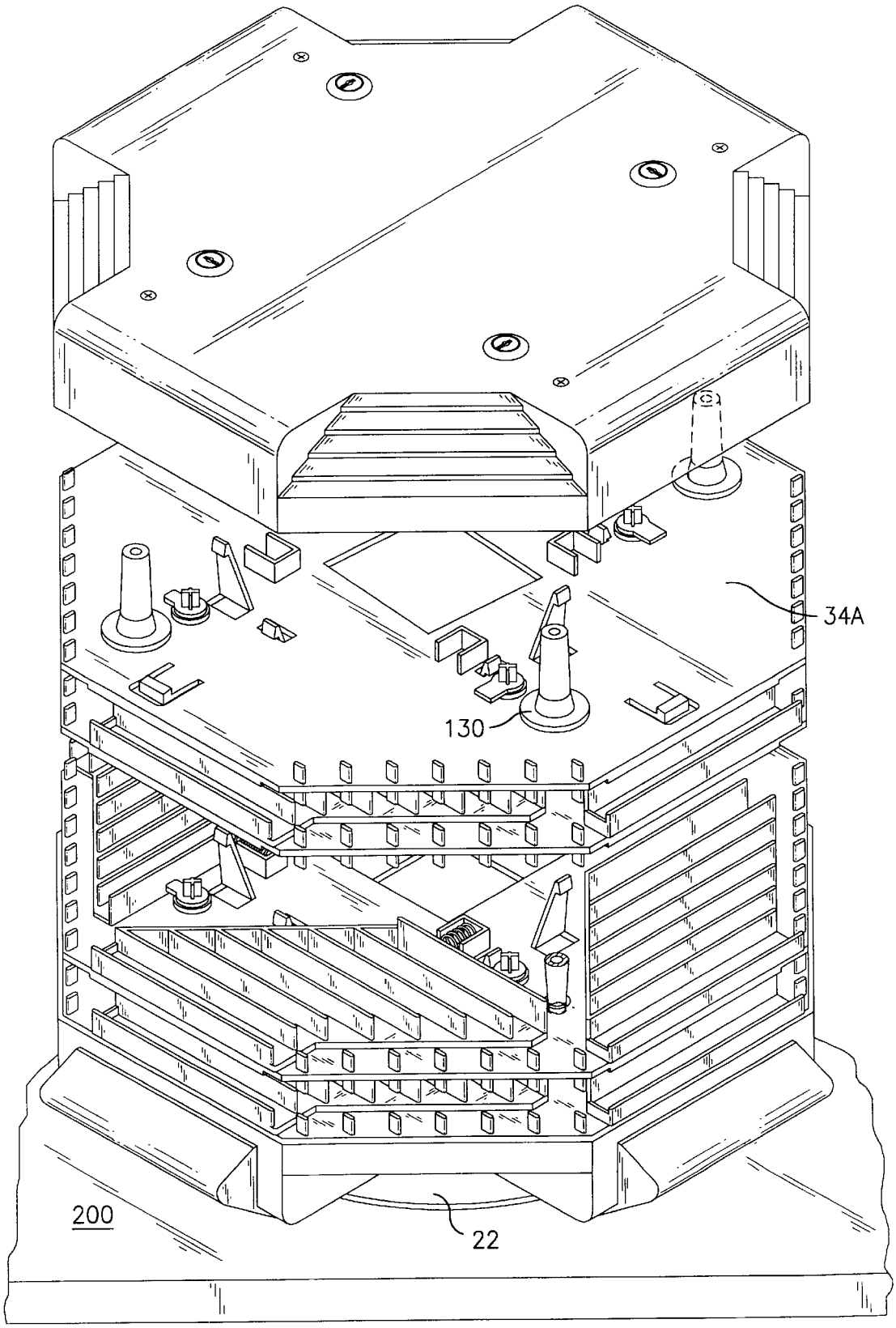
FIG. 2 is a partially exploded view of the device of FIG. 1.
Figure 3:
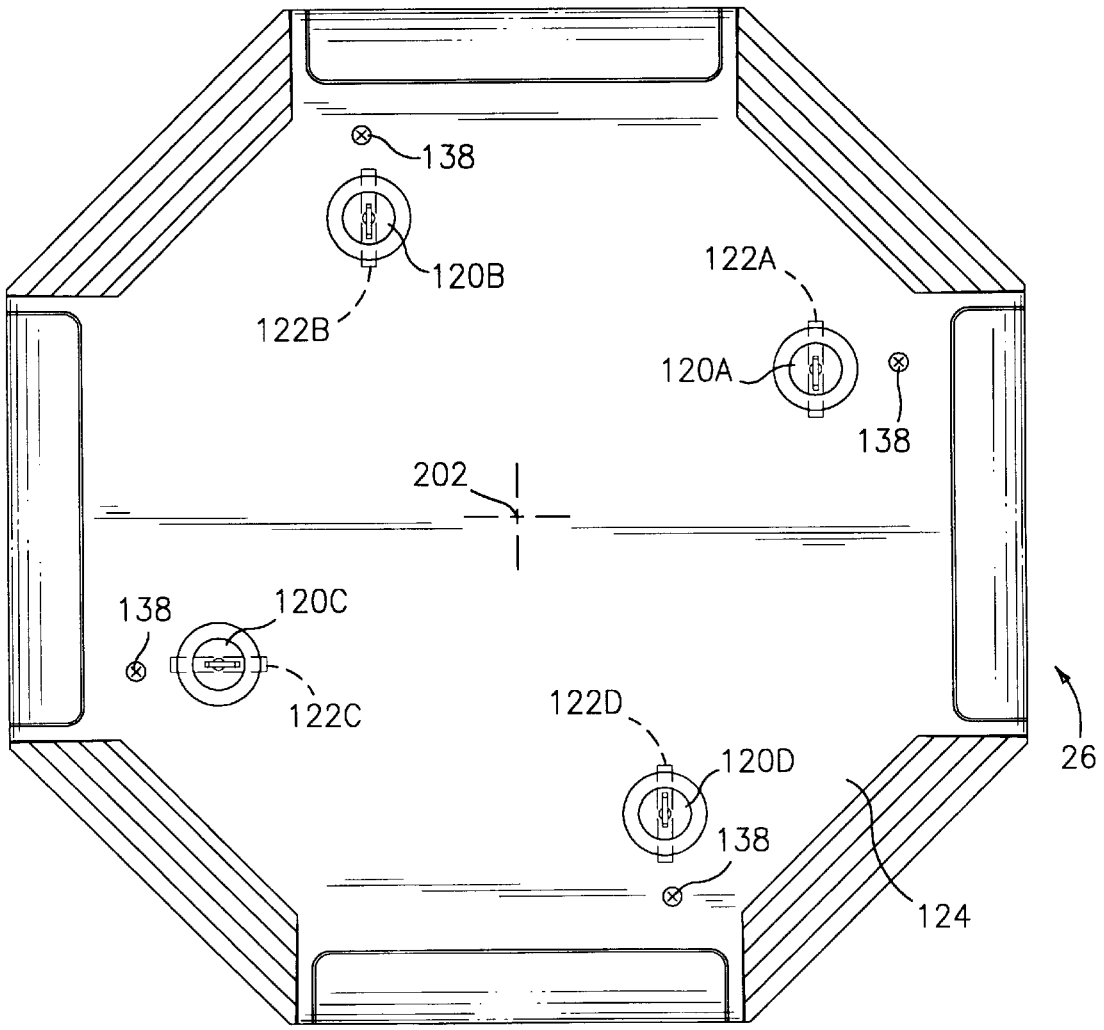
FIG. 3 is a top view of the device of FIG. 1.

As shown in FIGS. 1–3, a display 10 for displaying and dispensing boxes 20 of watchbands is positioned on a horizontal surface such as a countertop 200. The display 10 includes a turntable 22 to engage the countertop and the base 24 of the display. The turntable may be any appropriate mechanism for supporting the display above the countertop and allowing the base to rotate relative to the countertop about a vertical axis. For example, the turntable may comprise a pair of plates coupled by ball bearings in circular races concentric with the axis of rotation. A stack 28 of box-holding tiers 30 is positioned between the base 24 and a top 26 held above the base by the stack. There may be between one and any structurally feasible number of tiers in the stack. For purposes of subsequent reference, the stack includes a lowermost tier 30A, an uppermost tier 30B, and a penultimate tier 30C immediately below the uppermost tier. An appropriate number of additional tiers 30 may be stacked between the lowermost and penultimate tiers.

Figure 4:
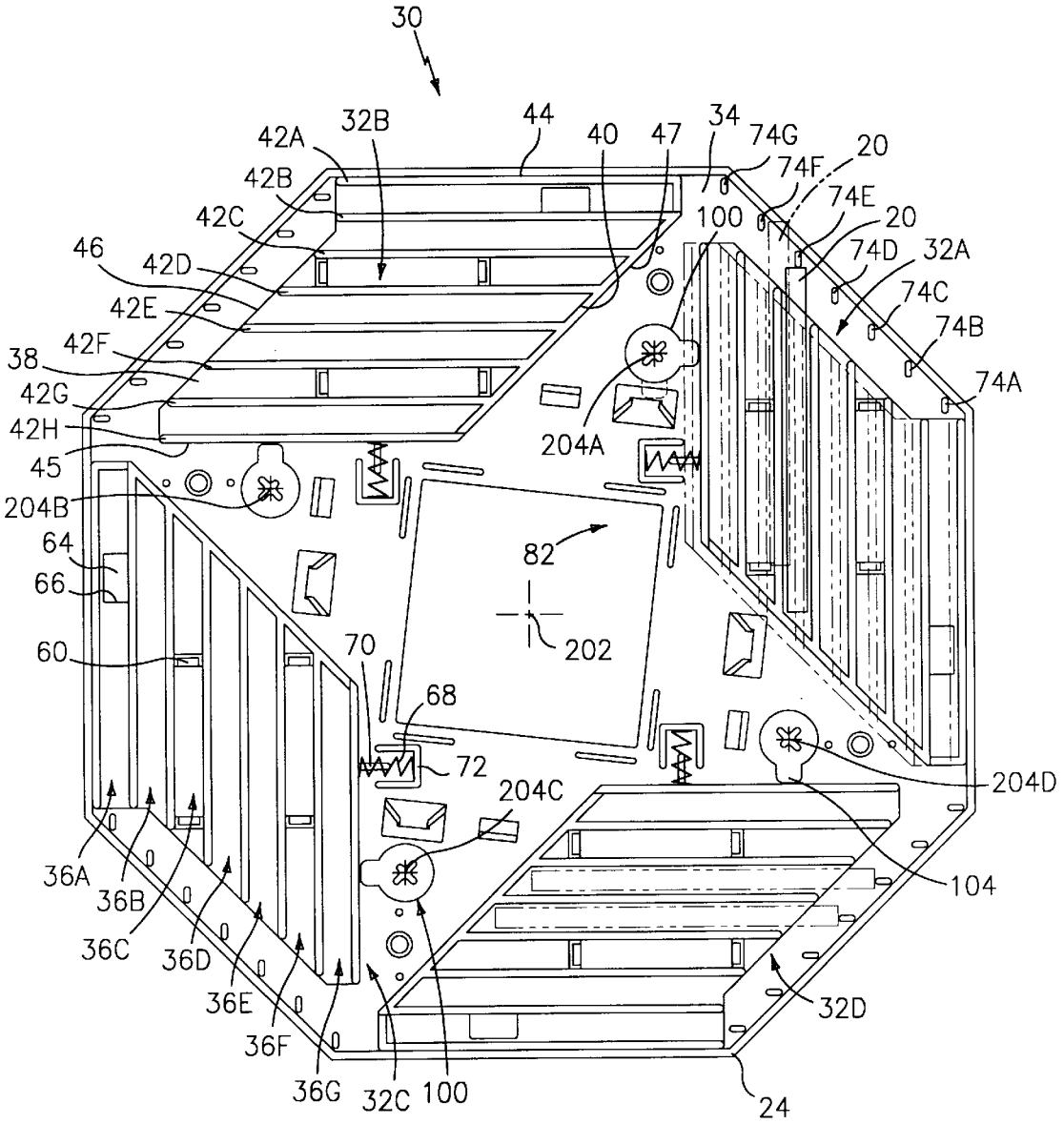
FIG. 4 is a top view of a single tier of the device of FIG. 1.

As shown in FIG. 4, each tier includes four drawers or trays 32A–32D, each formed as a unitary molding of transparent polystyrene plastic. Each group of four trays is carried on an associated plate or shelf 34, also unitarily molded of transparent polystyrene. Each tray 32A–32D includes seven stalls arrayed generally side-by-side with each other from an outboard stall 36A to an inboard stall 36G. In the illustrated embodiment, each shelf 34 is generally octagonal in plan and the four associated trays are positioned so that the outboard stalls 36A of the four trays fall generally along alternating sides of the octagonal perimeter of the shelf.

Figure 5:
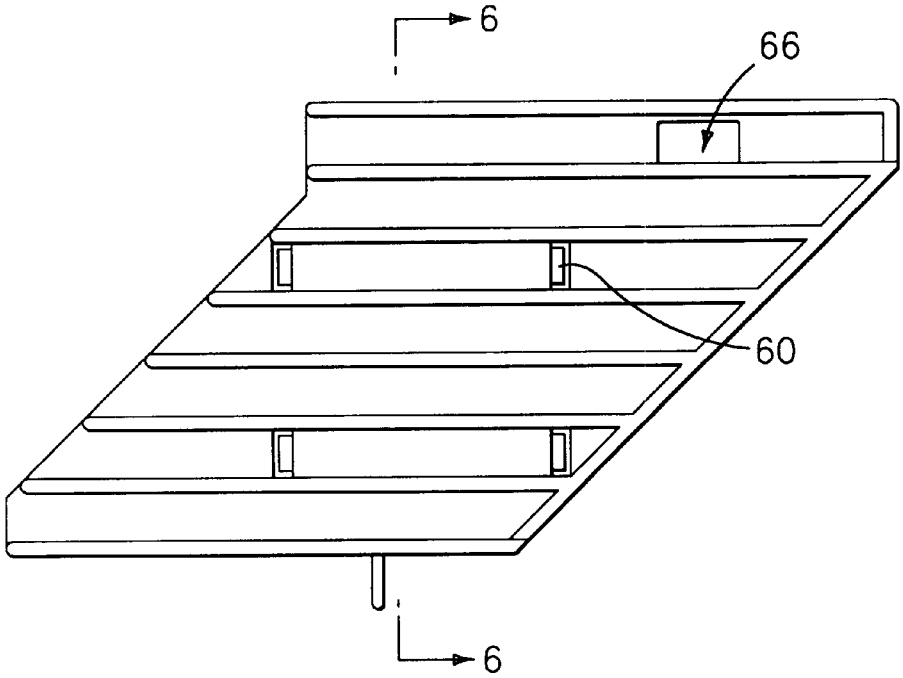
FIG. 5 is a top view of a tray of the tier of FIG. 4.
Figure 6:
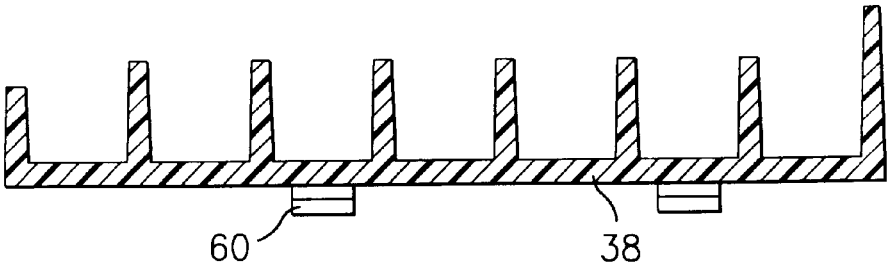
FIG. 6 is a side sectional view of the tray of FIG. 5

Within each tray 32A–32D, each stall is formed as an open channel having an open outboard end and a closed inboard end. Thus each stall has: a bottom face formed by the upper surface of a base portion 38 of the associated tray (FIG. 5); an inboard end face formed by the inboard surface of a single inboard end wall portion 40 of the tray; and inboard and outboard side faces formed by surfaces of longitudinal wall portions 42A–42H arrayed from an outboard wall along an outboard side 44 of the tray to an inboard wall along an inboard side 45 of the tray. Thus, the open ends of the stalls fall along the outboard end 46 of the tray and the closed ends fall along the inboard end 47 of the tray. The stalls are staggered so that the inboard and outboard ends of the tray are at substantially a 45° angle to the inboard and outboard sides of the tray. With this arrangement, the outboard ends of boxes held in the stalls fall generally along a line proximate a side of the octagonal perimeter of the shelf adjacent the side along which the outboard stall falls. position shown in solid lines in FIG. 4 and a second position, shown in phantom for tray 32A. Each tray is confined to movement along a single line by interfitting features 60 (FIG. 6) and 62 (FIG. 7) of the tray and shelf, formed as barbed projections and as slots, respectively. A releasable stop 64 on the shelf cooperates with respective outboard and inboard sides of an aperture 66 on the tray to prevent outward movement of the tray beyond the first position and inward movement beyond the second position. A coil-type compression spring 68 is held on a horizontal finger 70 projecting inward from the inboard wall 42H of the tray. The spring is held under compression between such inboard wall and an upright channel portion 72 of the shelf 34 to bias the tray toward its first position. When in the first position, each tray is aligned with a group of blocking members so that one such blocking member is centrally aligned with each stall and positioned adjacent the outboard end of any box contained in such stall. This blocks and prevents removal of the box. In the illustrated embodiment, each blocking member comprises a first finger 74A–74G projecting upward from the upper surface of the associated shelf and a second finger 76A–76G (FIG. 1) projecting downward from the lower surface or underside of the shelf immediately above the subject shelf (e.g., the shelf of the tier immediately above the subject tier). In the case of the uppermost tier 30B, the second fingers depend from a vacant (trayless) shelf 34A (FIG. 2) located immediately above the uppermost tier. When a tray is moved to its second position, the associated fingers 74A–74G and 76A–76G are approximately coplanar with the tray walls outboard of the associated stalls so that boxes held in the stalls may be extracted between adjacent pairs of fingers as shown in phantom for a box 20 in FIG. 4. In the exemplary embodiment, the channel defined by each stall is about 0.46 inches wide, about 5.4 inches long (from the associated blocking member to the nearest point of the inboard end wall portion 40 at the end of such stall) and about 1.1 inches high (measured from the upper surface of the base portion 38 to the underside of the shelf above the subject tier). The stall may thus accommodate a watchband box of dimensions up to approximately these stall dimensions. Advantageously, given the dimensions of the blocking members, the relative dimensions of the box and stall are such that the box cannot be readily removed from the stall with the tray in the first position but can readily be removed from the tray in the second position.

Figure 8:
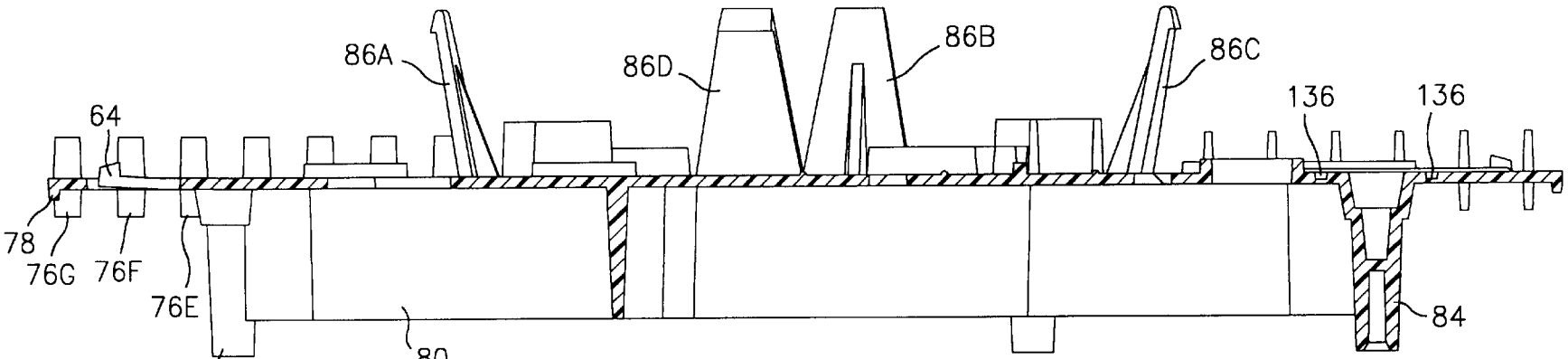
FIG. 8 is a side sectional view of the shelf of FIG. 7

Along the four sides of each shelf proximate the outboard side of an associated tray, there depends from the underside of the shelf an elongate rib 78 (FIGS. 1 and 8). Each rib 78 is positioned immediately above the outboard wall of the associated tray when the tray is in its first position. The rib cooperates with such outboard wall to prevent extraction of a box from the outboard stall 36A over the outboard wall 42A.

As shown in FIG. 8, depending from the underside of each shelf are a plurality of support and alignment features which engage the shelf below to support the former shelf and maintain it in lateral alignment with the shelf below. These features include a number of walls 80, including walls bounding a central aperture 82 (FIG. 4), which engage the upper surface of the shelf below and may be accommodated adjacent one or more bosses extending upward therefrom. The features further include compound frustoconical projections 84 having distal tips interfitting with apertures in upper (proximal) ends of similar frustoconical projections of the shelf below.

Figure 7:
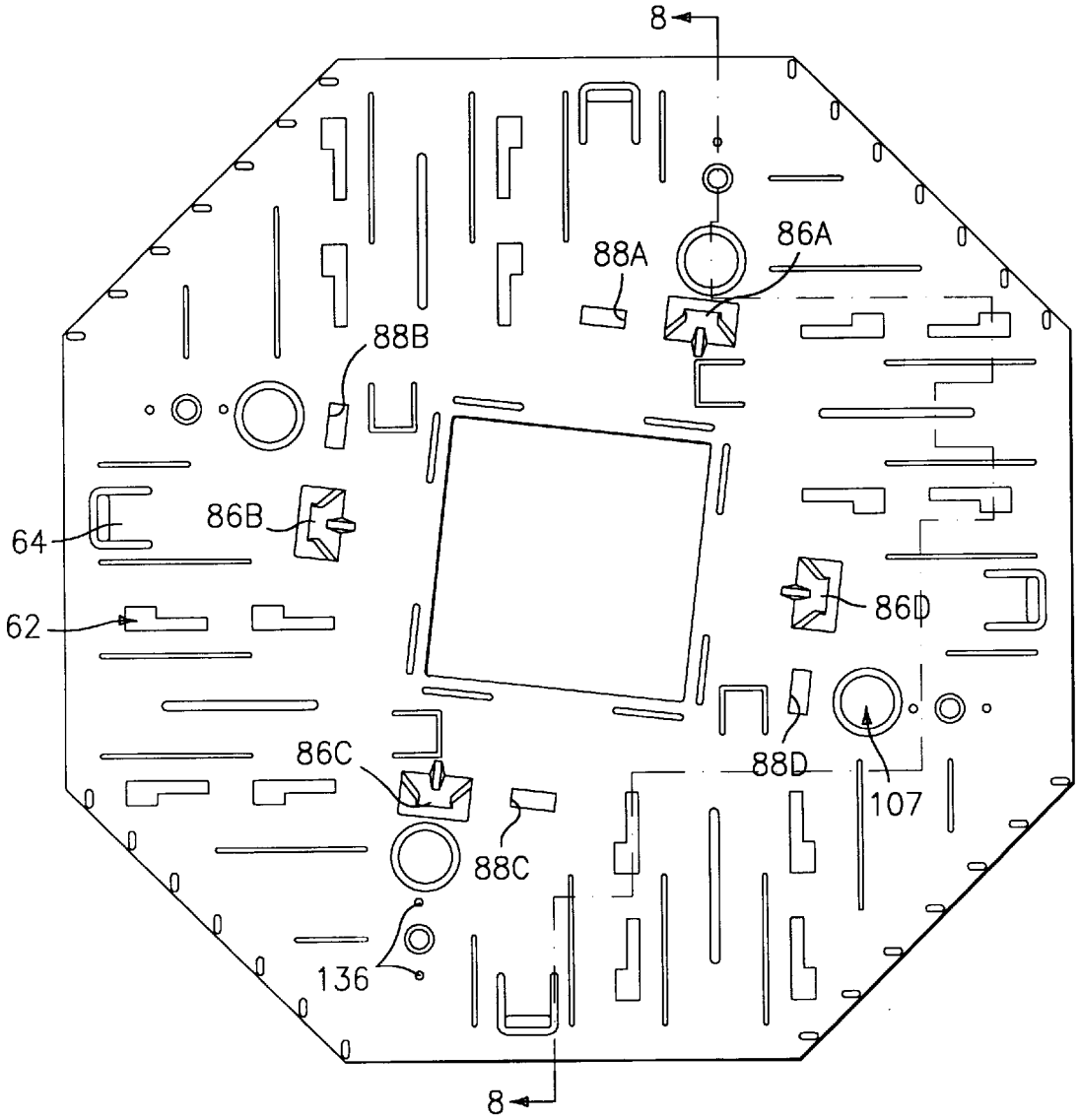
FIG. 7 is a top view of a shelf of the tier of FIG. 4.

To vertically secure adjacent shelves, each shelf is provided with four upwardly-directed barbed projections 86A–86D (FIGS. 7 & 8) and four associated apertures 88A–88D (FIG. 7). In the illustrated embodiment, when viewed from above, the projection 86A and its diametrically opposite projection 86C are located clockwise of their adjacent apertures 88A and 88C, respectively. The other pair of diametrically opposite projections 86B and 86D are counterclockwise of their associated apertures 88B and 88D, respectively. Thus, when one shelf is rotated 90° or 270° relative to the shelf below, the projections 86A–86D will align with the apertures 88A–88D, but out of phase (e.g. projection 86A with aperture 88B, etc.). When such shelves are brought together, the projections of the shelf below will extend through the apertures of the former shelf with the barbs engaging the upper surface of the former shelf at the perimeters of the apertures to secure the two shelves vertically together. In such a way, any number of shelves may be stacked atop each other and may maintain their vertical positions in both compression and tension.

Figure 11:
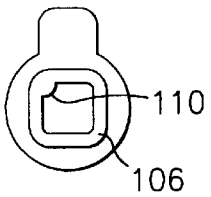
FIG. 11 is a bottom view of the locking element of FIG. 10.
Figure 10:
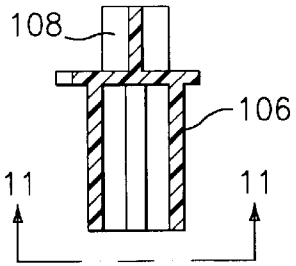
FIG. 10 is a side sectional view of the locking element of FIG. 9.
Figure 9:
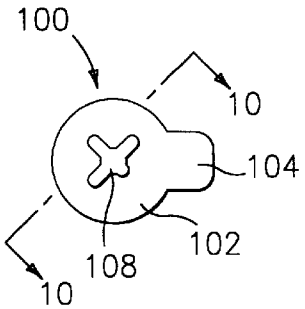
FIG. 9 is a top view of a locking element of the tier of FIG. 4.

As shown in FIG. 4, and in further detail in FIGS. 9–11, in each tier, associated with each tray 32A–32D is a latch or locking element 100 carried by the associated shelf 34. Each latch 100 is unitarily molded of transparent polystyrene and includes a disk-shaped flange 102 with a radially-projecting tab 104. Depending from the underside of the flange is a hollow, box-sectioned, shaft 106 which extends through an aperture 107 in the associated shelf 34. The flange 102 may ride atop the shelf about the aperture 107. A t-sectioned shaft 108 extends upward from the upper surface of the flange 102. The shaft 108 has four arms, of which one is truncated relative to the other three. The shafts 106 and 108 are dimensioned so that the shaft 108 of each latch is accommodated within the shaft 106 of the associated latch of the tier immediately above. Along one interior corner, each shaft 106 is provided with a bead 110 which provides a keying feature so that the latches may nest only with their tabs pointing in a common direction. Each of the four nested stacks of latches may be rotated about an associated vertical locking axis 204A–204D. Specifically, the stacks are rotatable between a first (locked) orientation shown in solid lines in FIG. 4 and a second (unlocked) orientation shown in phantom for the latch associated with tray 34A. In the locked orientation or condition, the tab 104 of each latch in the stack is facing the inboard wall 42H of the associated tray. In the locked orientation or condition, if a user attempts to press the tray from its first position toward its second position, the wall 42H contacts the tab 104, preventing the tray from reaching the second position. In the unlocked orientation, rotated 90° from the locked orientation, the latch and its tab do not prevent movement of the associated tray to that tray's second position.

To control rotation of the stacks of latches, a respective lock 120A–120D (FIG. 3) is associated with each stack. In the illustrated embodiment, each lock 120A–120D is a key-type lock configured to receive a key 122A–122D in an associated keyhole. The locks are securely held in associated apertures in a primary molded piece 124 of the top 26. The locks are coupled to the stacks of latches and, with their keys inserted, may rotate their associated stacks of latches between the locked (shown for locks 120B–120D) and unlocked (shown for lock 120A) orientations shown in FIG. 3. With the keys removed, the stacks are locked in either their locked or unlocked orientations.

Figure 12:
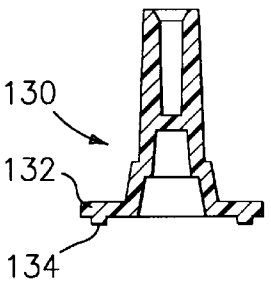
FIG. 12 is a side sectional view of a standoff for supporting a top of the device of FIG. 1.

To support the top 26 above the vacant shelf 34A (FIG. 2) above the uppermost tier 30B, such vacant shelf may carry four added standoffs 130 (shown in detail in FIG. 12). These standoffs have an annular base flange 132 from which depend a pair of alignment pins 134. The pins are received by a pair of matching holes 136 in the vacant shelf. As shown in FIG. 7, such holes 136 are provided in all the shelves. The standoffs may be secured to the vacant shelf via adhesive, welding, or by other means. Such a construction allows each shelf, including the vacant shelf, to be identically formed, thereby reducing manufacturing costs. Four screws 138 extend through the top 26 and into the threaded upper ends of the standoffs 130 to vertically secure the top 26 to the stack 28. To couple the latches 100 of the uppermost tier to their associated locks, the vacant shelf 34A is provided with four identical locking elements 100 carried in its apertures 107 and each forming part of its associated stack as previously described. The latches of the vacant shelf 34A, however, lack associated trays but for economy of manufacture are formed identically to the other latches. The upper shafts 108 of these four latches are received by mating features of the associated locks.

Figure 13:
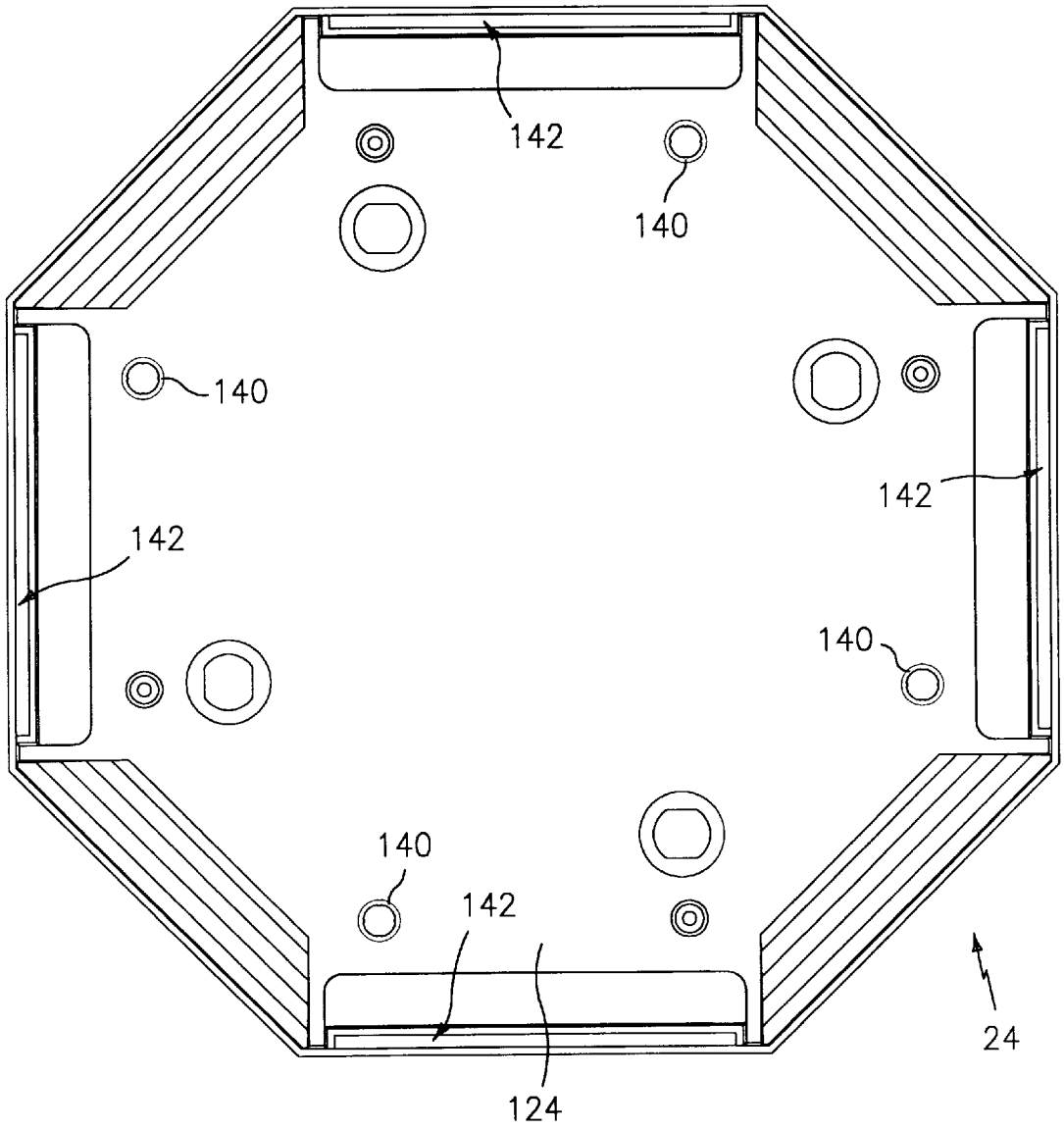
FIG. 13 is a view of an inner surface of a bottom of the display device of FIG. 1.

To further reduce manufacturing costs, the bottom 24 may be provided with the identical primary molded portion as the primary molded portion 124 of the top 26. Thus, as shown in FIG. 13, the inner surface of the primary molded portion is provided with four bosses 140. When used to form the bottom 24, the inner surface faces upward, with the bosses 140 receiving the tips of the projections 84 of the lowermost shelf (the shelf 34 of the lowermost tier 30A). The projections 84 of the lowermost shelf may be adhered or welded to the bottom 24. Alternatively, screws (not shown) may extend through the bottom and into threaded lower ends of such projections to vertically secure the bottom to the lowermost tier and thus to the stack. Four elongate grooves or channels 142 in the inner surface of the primary molded portion 124, along four sides thereof, receive the four ribs 78 of the shelf of the lowermost tier. This further supports such shelf and maintains its alignment with the bottom 24.

In use, when placed atop the countertop 200 or other surface, the carousel may be rotated about the vertical axis 202 to provide easy access to any of the four vertical arrays of trays. A consumer can thus readily view all of the watchbands in the display. The watchbands in the outboard stalls 36A may easily be viewed through and over the associated outboard wall 42A. The stagger of the stalls may allow at least a small portion of the bands in the remaining stalls to be viewed. However, it is envisioned that each band in a given tray may be of substantially the same style and thus upon viewing the band in the outboard stall, the consumer need only read size and color indicia from the outboard ends of the boxes in the remaining stalls. When the associated lock is turned to the unlocked orientation, the consumer may press on the outboard wall 42A of any tray in the vertical array of trays associated with such lock. The pressure moves that tray from its first position (blocked condition) to its second position (unblocked condition), compressing the associated spring 68. While maintaining such pressure, the consumer uses his or her other hand to remove any box from the tray, with the box passing between an adjacent pair of blocking members as shown in broken lines in FIG. 4. Release of the pressure allows the spring to snap the tray back to its blocked condition whereupon the associated stack may be relocked. The replacement or restocking of the boxes may be achieved via a reverse of these steps.

Tiers may readily be added to or removed from the stack. To do so, the screws 138 are removed, allowing the top 26 to be lifted off of the vacant shelf 34A. This also disengages the locks 120A–120D from their associated stacks of nested latches 100. The vacant shelf 34A may then be removed by pressing inward on the projections 86A–86D of the shelf immediately below (the shelf 34 of the uppermost tier 30B) to disengage the barbs of those projections from the apertures 88A–88D of the vacant shelf 34A. While maintaining the pressure to disengage the barbs, the vacant shelf 34A may be lifted over such barbs (which may be done sequentially or all at once). This lifts the vacant shelf and the four latches 100 it carries out of engagement with the shelf 34 of the uppermost tier 30B and its four latches 100. At this point, tiers may be added or removed.

Removal of tiers is accomplished in similar fashion to the removal of the vacant shelf, although the shelf being removed carries trays and associated hardware. Addition of tiers may be done by sequentially adding individual tiers or adding a group of tiers. To add a tier, its shelf is placed over the exposed shelf of the present uppermost tier in the aforementioned 90° (or 270° given the exemplary symmetries) relative rotation. The shelf of the added tier is simply pressed into place with the barbed projections 86A–86D of the shelf of the present uppermost tier snapping through and engaging the apertures 88A–88D of the shelf of the added tier so that the added tier becomes the new uppermost tier. The latches of the added tier may then be put in place, nested atop the latches of the former uppermost tier, so that their respective tabs are properly aligned. This process may be repeated with additional tiers, and, when finished, the vacant shelf 34A may be replaced along with its latches and the top replaced.

Even without the locks, the basic construction of the device is useful to prevent accidental removal of the boxes. For example, the centrifugal effect resulting from rotation of the carousel might allow boxes to be ejected from the carousel absent the presence of the blocking members. Additionally, such construction helps retain the boxes in the carousel during movement (transportation) of the carousel. Furthermore, the carousel and its associated components need not be strong enough to prevent a thief from breaking the carousel to remove the boxes. Significant deterrence to pilferage is presented by even the weakest locking features.

Although one or more embodiments of the present invention have been described, it will nevertheless be understood that various modifications may be made without departing from the spirit and scope of the invention. For example, a single central locking system may be utilized. Additionally, although the illustrated embodiment features a high degree of modularity and a relatively small number of different parts, many of the advantages may be preserved in systems which trade the simplicity of manufacture and modularity for a greater degree of ornateness or other additional features. Furthermore, the system may be resized or rescaled either for use with the exemplary watchbands or for use with other goods, for example, fountain pens, compact disks, etc. Accordingly, other embodiments are within the scope of the following claims.

I claim:

1. A device for displaying and dispensing elongate articles above a horizontal surface, comprising:

a turntable for engaging the surface and supporting the device;

a base, held above the turntable for rotation about a central vertical axis;

a top, held above the base; and a stack of article-holding tiers positioned between the base and the top, each of said tiers having:

a plurality of groups of elongate stalls, each of said stalls being configured to hold one of the articles, each of said stalls in each of said groups being situated in a side-by-side array, and each of said stalls having an outboard end; and a plurality of groups of blocking members, each group of blocking members being associated with a corresponding one of said plurality of groups of elongate stalls and each of said blocking members being associated with one of said stalls in said associated group of stalls, either each group of blocking members or said group of stalls associated therewith being a moveable group, said movable group being slideably moveable as a unit from a first position wherein the blocking members effectively prevent removal of the articles held by the associated stalls to a second position to permit extraction of the articles from said stalls, the moveable group being biased toward the first position.

2. The device of claim 1 wherein the horizontal surface is a countertop.

3. The device of claim 1 wherein the groups of stalls are the moveable groups and in each group of stalls, the stalls are arrayed from an outboard stall to an inboard stall, the outboard stall extending generally along a perimeter of the associated tier.

4. The device of claim 3 wherein each stall has a bottom face, an outboard side face, an inboard side face, and an inboard end face.

5. The device of claim 3 wherein in each tier there are four such groups of stalls and four such groups of blocking members, each tier having a substantially octagonal perimeter and wherein the stalls in each group of stalls are staggered so that outboard ends of articles held by such stalls fall along a line proximate one side of such octagonal perimeter and the outboard stall falls generally along an adjacent side of such octagonal perimeter.

6. The device of claim 3 wherein for each tier:

there is an associated unitarily molded plastic shelf;

each group of stalls is formed by a unitarily molded tray, slidably carried atop the associated shelf for translation between the associated first and second positions; and each group of blocking members comprises a plurality of upwardly extending fingers of the associated shelf.

7. The device of claim 6 wherein of each given tier of a lowermost such tier to a penultimate such tier, each group of blocking members further comprises a plurality of fingers depending from an underside of the shelf associated with the tier above the given tier.

8. The device of claim 6 wherein each tier includes at least one latch moveable between:

a locked condition in which the latch prevents movement of an associated one of the trays of such tier to such tray's second position; and an unlocked condition in which the latch does not prevent movement of such tray to such tray's second position.

9. The device of claim 8 wherein of each given tier of a lowermost such tier to a penultimate such tier, each such latch is coupled to a latch of the tier above the given tier so as to be driveable between the locked and unlocked conditions via the latch of the tier above the given tier.

10. The device of claim 9 wherein each such latch of an uppermost tier is coupled to an associated lock carried by the top.

11. The device of claim 3 wherein the base consists essentially of a first molded piece, and the top consists essentially of a second molded piece, substantially identical to the first molded piece.

12. The device of claim 3 configured to so display and dispense such articles being 0.435 inches wide by 0.980 inches high by 5.35 inches long.

13. The device of claim 3 displaying a plurality of boxed watchbands.

* * * * *